United States Patent [19]

Zlotnicki

[11] Patent Number: 4,510,637

[45] Date of Patent: Apr. 16, 1985

[54] BRIDGE LAUNCHER

[76] Inventor: Lucjan Zlotnicki, R.D. 3, Box 3591, Spring Grove, Pa. 17362

[21] Appl. No.: 475,371

[22] Filed: Mar. 14, 1983

[51] Int. Cl.[3] ..... E01D 15/12

[52] U.S. Cl. ..... 14/2.4

[58] Field of Search ..... 14/2.4, 2.6, 1; 414/919, 10; 52/115, 117; 180/190, 193, 199, 9.32, 9.46

[56] References Cited

U.S. PATENT DOCUMENTS

| | | | |
|---|---|---|---|
| 2,556,175 | 6/1951 | Frost | 14/2.4 |
| 3,305,885 | 2/1967 | Vaillant et al. | 14/2.4 |
| 3,488,787 | 1/1970 | Söffge | 14/2.4 |
| 3,491,391 | 1/1970 | Söffge | 14/2.4 |
| 3,562,829 | 2/1971 | Söffge | 14/2.4 |
| 3,845,514 | 11/1974 | Wagner | 14/1 |
| 3,985,254 | 10/1976 | Grandury | 414/919 X |
| 4,023,226 | 5/1977 | Söffge et al. | 14/2.4 |
| 4,062,081 | 12/1977 | Ramer | 14/1 |
| 4,347,692 | 9/1982 | Culver | 52/117 |

FOREIGN PATENT DOCUMENTS

| | | | |
|---|---|---|---|
| 3011222 | 10/1981 | Fed. Rep. of Germany | 14/2.4 |
| 87276 | 5/1966 | France | 14/1 |
| 180327 | 8/1962 | Sweden | 14/1 |

*Primary Examiner*—James A. Leppink
*Assistant Examiner*—Beverly E. Hjorth

[57] ABSTRACT

A bridge launching and retrieving mechanism after mounting on a vehicle forms a bridge transporting, launching and retrieving vehicle. The launching and retrieving mechanism includes input, follower and coupler links which are pivotably interconnected, and input and follower links are pivotably mounted to a support means or to a vehicle itself. An interfacing means is pivotably attached to the coupler and provides rigid temporary interface between a bridge and the mechanism. To allow a bridge to be launched in different directions, the launching mechanism is mounted on support means in the form of a basket rotatably mounted in the vehicle's body. The preferred embodiments use two parallel linkage arrangements each having at least an input link, a coupler link, a follower link and a support means. An embodiment uses variable length links and variable position of pivots of the links so that the footing portion of the coupler may be placed on the ground at a variable distance from the vehicle body. Proper positioning of link attachment points results in automatic return of the vehicle to the earth if it is lifted from the earth during launch or retrieval of a bridge.

31 Claims, 16 Drawing Figures

BRIDGE LAUNCHER

FIELD OF THE INVENTION

This invention relates to a bridge launching and retrieving mechanism and includes a transporting vehicle for quickly establishing and removing bridges.

THE PRIOR ART DESCRIPTION

The bridge launchers are used to establish a roadway across a river, a natural or manmade ground opening or irregularity or otherwise difficult if not impossible to cross obstacle for machines and people. Diversity of bridge launchers constructions have heretofore been known in the art.

Usually the bridge can be removed by the same bridge launching vehicle and it can be used at the next obstacle or also to control the use of the bridge and to allow passage under the bridge. Thus the bridge launchers must operate the bridge in relatively short period of time. Also since such bridge launching vehicles are used in difficult terrain configuration, they often are endless track vehicles constructed with the same traction and power drive mechanisms and chassis as commonly used on tanks.

Known prior art bridge launchers are subject to one or more of various disadvantages.

Bridge launchers of the type having launching mechanism pivots on the front or back of a vehicle (self propelled or towed) have several common problems. If self propelled, the position of a driver/operator is generally off center and his visibility field is severely limited in both forward and side directions. The mobility of such a vehicle is usually impaired due to the heavy structure of the front, which places the center of gravity of the bridge launching mechanism forward of the geometrical center of the vehicle. The supporting point for stability can only be placed in a fixed distance from the vehicle's center of gravity thus usually allowing only one weight/length bridge to be used with it. Any meaningful change of bridge weight and/or length commonly requires extensive redesign of the launcher.

The disadvantage of having the heavy bridge launching structure located on the front (or the back) of the vehicle is quite significant. If the bridge must be extended out in front of the vehicle's front, this places a great force moment on the vehicle which would cause tipping of the vehicle. Also mobility of such a bridge launching vehicle in the transport mode is impaired causing requirement for relatively low travel speed.

In order to prevent the vehicle from tipping, the weight and/or length of the bridge is greatly restricted. Additionally, anchors or similar devices are used to support the front of the vehicle against tipping downwardly. However, such anchors are generally limited to placement a fixed distance from the vehicle's center of gravity and therefore the range of weight/length bridge is quite restricted.

Another type of prior art bridge launcher is designed with a launching beam which is launched first to give a supporting point, usually on the other bank of the river or gap. This allowed heavier and/or longer bridges to be used. However, such bridge launching mechanisms generally require a very complicated arrangement. Also this type of launcher requires exceptionally close dimensional tolerances of the launcher components, as well as the manufacture of undistorted bridge components which are costly to obtain. Further, reliability of such launchers is relatively low. In addition, the launching usually has to be performed in series meaning that the next step of a launching sequence cannot be started before a previous step is completed, thereby requiring more time than would otherwise be the case. As with the pivoting type of structure, the weight and length of the bridges is still restricted by the need to avoid tipping and anchors are often used to secure the vehicle when launching the bridge.

A disadvantage of many prior art bridge launchers is their limited suitability for use when an inclined bridge must be established. For example, if the gap which must be bridged is between two hills of different heights, the bridge must be inclined up or down from the launch side of the gap. Not only are many prior art bridge launching vehicles unable to establish bridges at a substantial angle with respect to the horizontal plane or the plane on which the launching vehicle is positioned, but such vehicles usually must themselves be approximately level to launch a bridge.

A general object of the invention is to provide a new and improved bridge launcher.

A further object of the present invention is to provide a bridge launcher wherein different weights and lengths of bridges may be used without subjecting the launcher to tipping.

A still further object of the present invention is to provide a bridge launcher having good driver/operator visibility in both forward and side directions.

Another object of the present invention is to provide a highly stable bridge launcher.

Yet another object of the present invention is to provide a bridge launching mechanism wherein most or all launching sequence steps may start simultaneously.

A further object of the present invention is to provide a bridge launcher which establishes a supporting point for the bridge launching at a variable or adjustable distance from the vehicle in order to handle a wide variety of weight and/or length bridges.

A still further object of the present invention is to provide a bridge launcher which can establish an inclined bridge.

Yet another object of the present invention is to provide a bridge launching vehicle which can launch a bridge when the vehicle is on a significant incline.

A still further object of the present invention is to provide a bridge launcher which can increase a balancing force moment by a simple self-correcting action during or after launching.

SUMMARY OF THE INVENTION

These and other objects of the present invention and the attendant advantages which will become apparent as the description proceeds are realized by a bridge transporting and launching vehicle comprising: a vehicle body and chassis, at least one input link pivotably attached to and movable relative to the vehicle body by at least one input actuator, at least one follower link pivotably attached to the vehicle body, and at least one coupler having a footing portion at a first end, a middle portion and a second end opposite the first end.

The input link is attached pivotably to the coupler, the follower link is pivotably attached to the coupler, and the vehicle is operable to launch a bridge by moving, by means of input actuator, at least a part of the input link which in turn moves the coupler link, which in turns moves the follower link.

In the preferred embodiment, the input link is attached to the second end of the coupler link and the follower link is attached to the middle portion of the coupler. It should be understood that the input actuator can be attached to the link which is attached to the middle portion of the coupler and called the follower link, in which case that said link will become the input link, and the link attached to the second end of the coupler link and called the input link will then become the follower link. For convenience, I may refer to either input/follower link as a side link.

The side link attached to the second end of the coupler is longer than the side link attached to the middle portion of the coupler link. In operation, the links move until the footing portion of the first end of the coupler link touches the ground with the second end of the coupler link disposed above the ground when the footing portion touches the ground.

The input actuator can also act between any two of the four following elements: the vehicle body, the coupler link, the side link attached to the middle portion of the coupler link, and the side link attached to the second end of the coupler link.

In the preferred embodiment, the input actuator is shown to be attached to the vehicle body and to the side link attached to the second end of the coupler link.

The launcher further comprises: at least one tongue pivotably attached to the first end of the coupler link and at least one tongue actuator attached to the tongue for moving the tongue relative to the coupler link. The tongue actuator is pivotably attached to the coupler link or the follower link. Alternately, an intermediate member is pivotably attached to the first end of the coupler link, an intermediate actuator is attached between the intermediate member and the coupler link to move the intermediate member relative to the coupler link, and tongue actuator is attached between the intermediate member and the tongue to move the tongue relative to the coupler link and the intermediate member. One or both of the input and follower links may be adjustable in length. One or both of the ends of one or both of the input and follower links may be adjustable in positioning of the respective pivots on the vehicle's body and on the coupler link. The input link, input actuator, follower link, coupler link and all other components attached to them are rotatable with respect to the vehicle body, about a vertical axis of rotation for launching bridges in different directions relative to the vehicle body. In the preferred embodiment, the vehicle further comprises a second input link, a second middle link, a second coupler, and a second input actuator attached and operable in the same fashion as the like named components described above. The bridge launching mechanism according to the present invention comprises: a support means, at least one coupler link having a footing portion disposed at a first end, a middle portion and a second end opposite the first end, and at least one side link pivotably attached on one end of the middle portion of the coupler link and at the other end to the support means, and at least one input actuation means for moving the coupler link relative to the support means. The input actuation means is operative to launch the bridge by moving the first end of the coupler link forwardly down until the footing portion touches the ground and the second end of the coupler link forwardly up. Forward direction is herein defined as the general direction travelled horizontally in going from the second end of the coupler link to the first end of the coupler link. Upward and downward motion are defined with respect to the resting coupler position before launching.

The bridge launching and transporting vehicle according to the present invention also comprises: a vehicle body, a rotatable base means mounted to the vehicle body and a bridge launching mechanism mounted to the rotatable base means and wherein the rotatable base means is rotatable about a vertical axis with respect to the vehicle body such that the bridge launching mechanism is operative to launch bridges in different directions relative to the vehicle body.

The rotatable base means includes a basket mounted in a hole of the vehicle body. The bridge launching mechanism also includes a footing portion and is operative to place the footing portion on the ground at variable distances from the vehicle body.

In an especially preferred embodiment, the side links are attached to the support means or vehicle body at such points with respect to the vehicle's center of gravity that if the launching vehicle becomes lifted off the ground during launching, the vehicle will move itself further away from the footing portion and thus create an increase in balancing moment about the footing portion which will cause the vehicle to touch the ground again and continue the operation.

BRIEF DESCRIPTION OF THE DRAWINGS

The above and other features of the present invention will best be understood when considered in conjunction with the following detailed description and the accompanying drawings wherein like characters represent like parts throughout the several views.

DETAILED DESCRIPTION OF THE PREFERRED EMBODIMENTS

The following numbering convention is used on all drawings: like characters represent like parts, if two identical parts are symmetrically located with respect to the longer axis of the launcher, they have the same number with character L for left side or R for right side looking in a forward direction as defined hereinabove. Also, each embodiment presented in a separate figure has numbers starting with a digit showing the embodiment number as used in the description. Thus, for example, the first embodiment has numbers in the 100 series, the second embodiment has numbers in the 200 series, the last two digits are the same for similar parts in all embodiments. For example, number 322L is the left (L) coupler link (22) in the third (3) embodiment, and number 122L is the left coupler link in the first embodiment.

Figure 2:
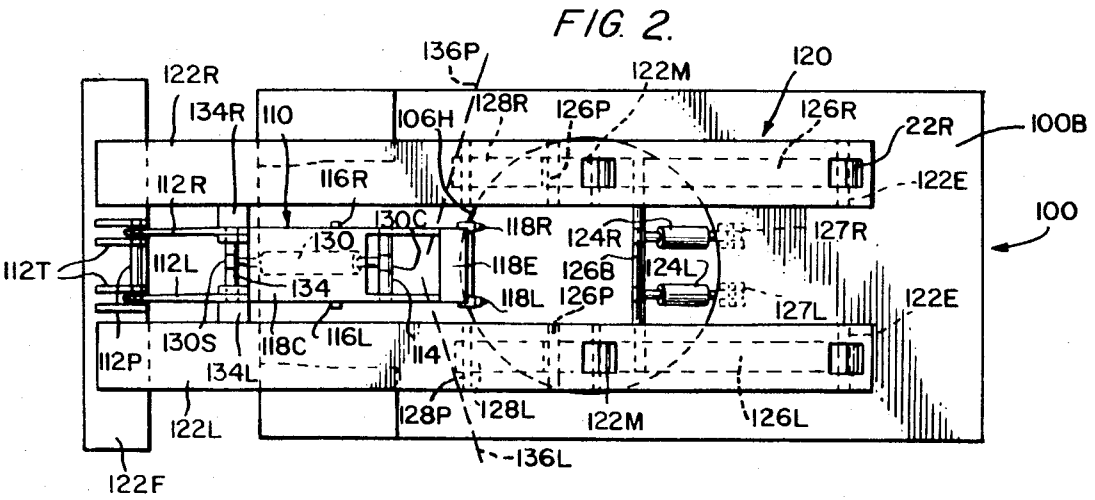
FIG. 2 shows a top view of the first embodiment of the present invention.
Figure 1:
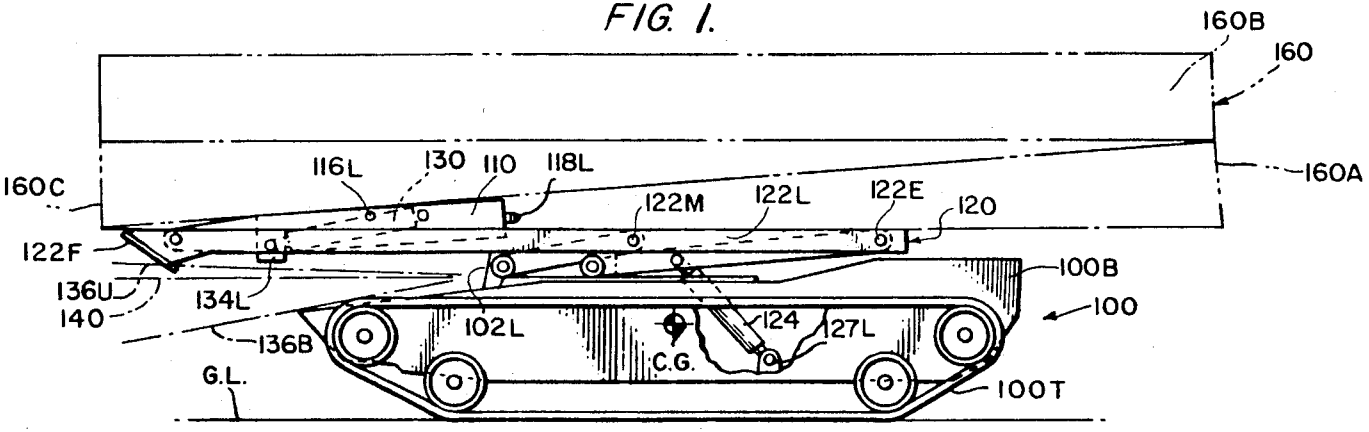
FIG. 1 shows a side view of a first embodiment of the present invention.

Referring to FIG. 1 and FIG. 2, a bridge launching vehicle 100, according to the present invention, is shown in a travel state (i.e. bridge folded on top of the vehicle). The bridge 160 is shown in simplified form in the side view in FIG. 1 and for case of illustration is not shown in the top view of FIG. 2. The vehicle 100 includes a vehicle body 100B and endless tracks 100T on both sides of the body. Since the vehicle body 100B, endless track 100T, engine (not shown) and power transmission (not shown) are known in the art, no specific details will be discussed herein.

The construction of the bridge launcher 120 will be described with reference to FIGS. 1 through 4. Since the launcher 120 arrangements are mirror images with respect to the longer axis of the vehicle 100, the following description may emphasize the left linkage arrangement and; similarly, the left side linkage arrangement may be emphasized for the other embodiments of the present invention. It will also be understood that the left side view shows the minimum number of components needed for operation of the launcher.

Figure 3:
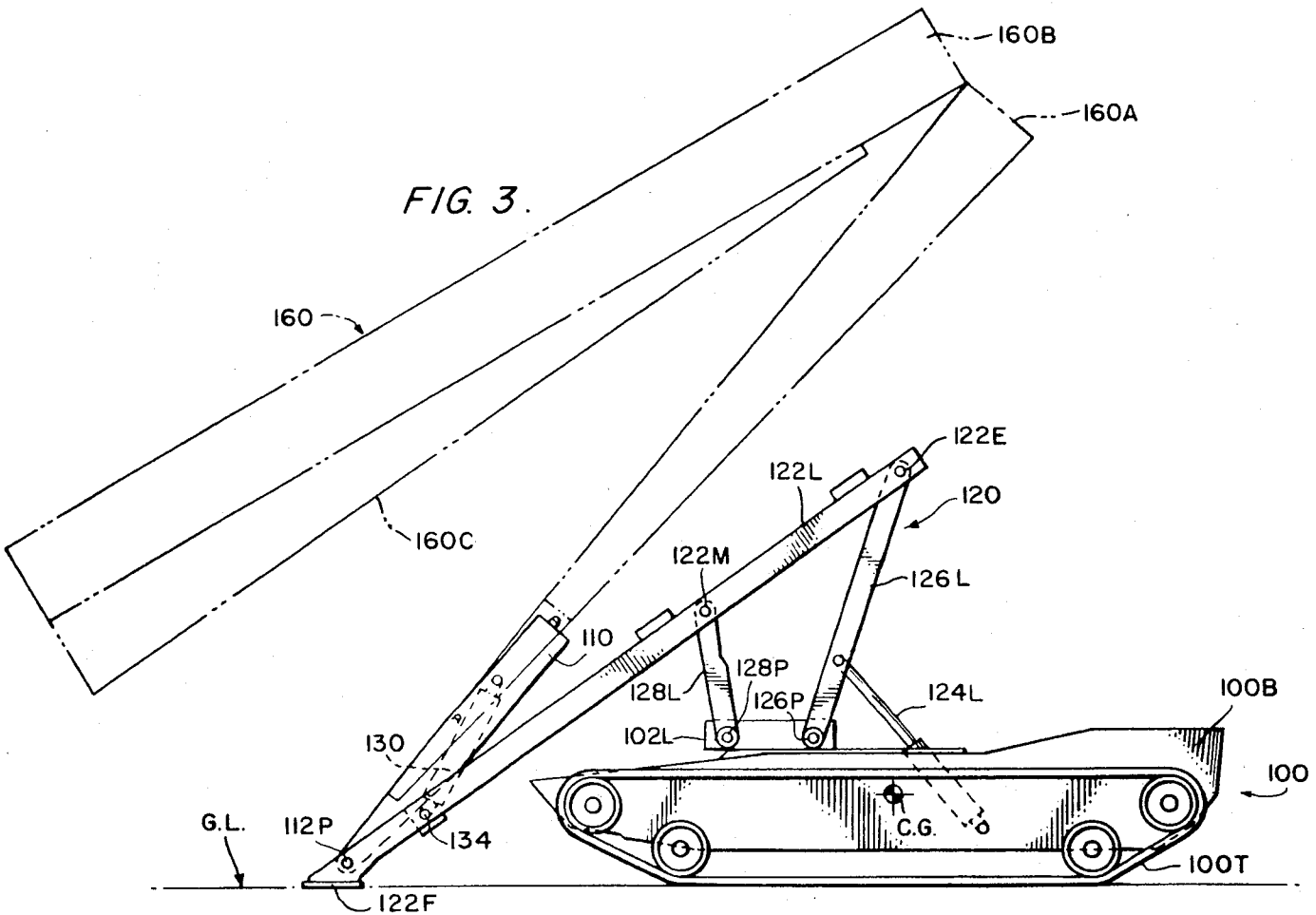
FIG. 3 shows a side view of the first embodiment of the present invention in the process of launching a bridge.
Figure 4:
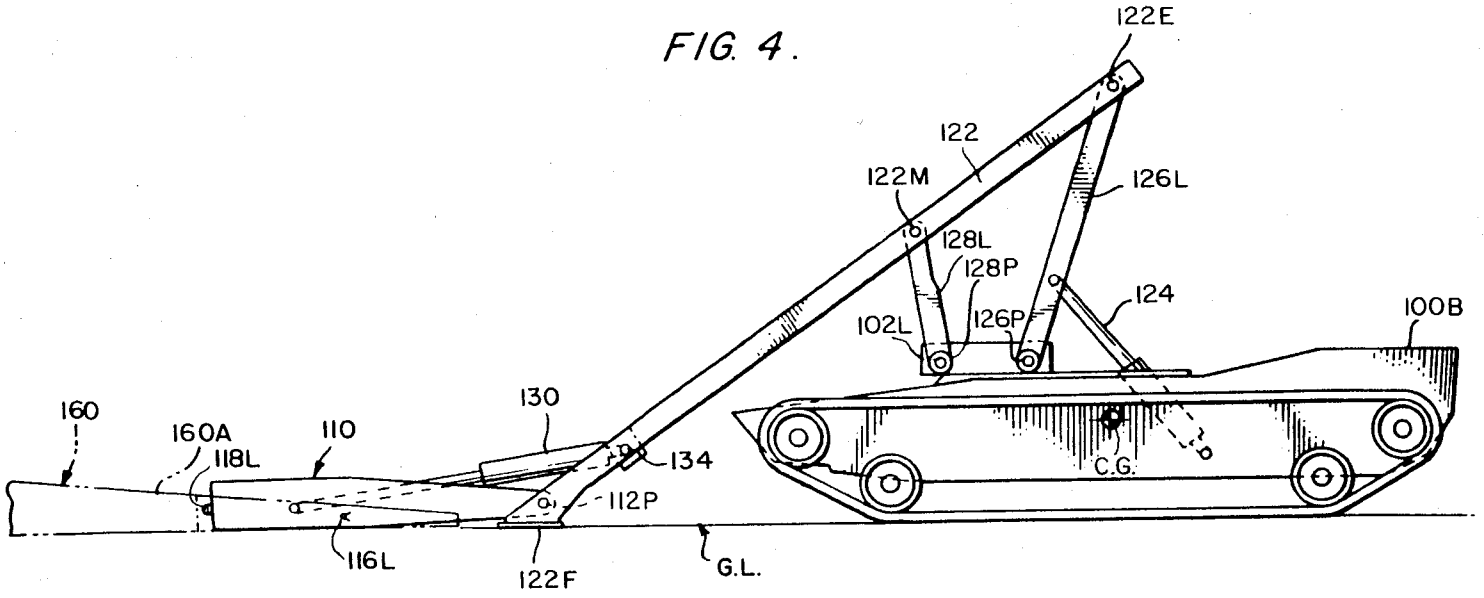
FIG. 4 shows a side view of the first embodiment of the present invention with the bridge launched and the bridfe launching mechanism ready for removal from the bridge.

FIG. 3 shows the bridge launcher 120 during launching with the bridge 160 partially unfolded. FIG. 4 shows the bridge launcher 120 in a launch position with the bridge 160 completely unfolded and vehicle 100 ready for withdrawal of the tongue 110 from the bridge 160.

The bridge launching mechanism 120 includes right and left input links 126L and 126R pivotably attached to the vehicle body 100B at right and left support means 102R and 102L. Input links 126L and 126R are connected by a connecting bar 126B to which input actuators 124R and 124L are connected.

The input actuators 124R and 124L have their opposite ends connected to the vehicle body 100B by support means 127R and 127L. Follower links 128R and 128L are pivotably attached through support means 102R and 102L to the vehicle body 100B. The links 126L, 128L, 126R and 128R are pivotably attached respectively to the left and right coupler links 122L and 122R. Each of the coupler links 122L and 122R includes a second end pivot points 122R pivotably attaching links 126R and 126L and middle portion pivot points 122M pivotably attaching links 128R and 128L.

The couplers 122L and 122R include the footing portion 122F which, referring to FIG. 2, extends between the right and left couplers 122L and 122R. The footing 122F is disposed at the first end of the coupler links 122L and 122R opposite second end pivot point 122E. The footing portion 122F is preferably a member permanently attached to the coupler links 122L and 122R. However, it could alternately be part of the coupler links or a member movable relative to the coupler links.

The tongue 110 is pivotably attached to the footing portion 122F of the coupler links 122L and 122R. The tongue 110 includes guide pins 116L and 116R mounted on the left and right parts 112L and 112R of the tongue 110. The tongue 110 further includes connecting piece 118C and an end piece 118E having pins 118P for locking the tongue 110 in the bridge 160. In addition, a tongue actuator pivot 114 extends between members 116L and 116R. The tongue actuator 130 is pivotably attached by connecting sleeves 130C and 130S to actuator pivots 114 and 134 respectively.

The tongue actuator pivot 134 extends between mounting means 134L and 134R attached to the coupler links 122L and 122R respectively. As shown the mounting means 134L and 134R are located on the coupler links 122L and 122R between the middle portion pivot 122M and the footing 122F.

The basic sequence of operation in launching a bridge 160 from the present bridge launching vehicle 100 by using the bridge launching mechanism 120 follows. As shown on FIGS. 1 and 2, the bridge launching mechanism 120 is in a rest or retracted position.

The center of gravity C.G. will be in approximately the same horizontal position for the vehicle with the bridge launching mechanism and a bridge mounted on top as for the vehicle 100 without the mechanism and without the bridge mounted on top. The input actuators 124L and 124R are fully contracted.

To begin the launching operation, the input actuators 124L and 124R are activated to push against the bar 126B, which pushes against the input links 126L and 126R causing them to pivot counterclockwise. The input links 126L and 126R cause the coupler links 122L and 122R to move forwardly up at their second end. The movement of the coupler links 122L and 122R causes the follower links 128L and 128R to move in counterclockwise direction causing the coupler links 122R and 122L to move at their first end of footing portion 122F initially in a forwardly up direction. The combined motion of interconnected input links 126R and 126L, coupler links 122R and 122L, and follower links 128R and 128L finally causes the second end of the coupler links (122E) to be in forwardly up position and the footing portion (122F) to be in forwardly down position with respect to the rest or retracted position. The footing portion 122F will rest on the ground line GL as shown on FIG. 3.

Although the views of FIGS. 1, 3 and 4 show only the left members, it will be readily understood that the corresponding right members operate in exactly the same fashion and at the same time as the left side members. It will be readily understood that the corresponding right side members are simply behind the corresponding left side members in the views of FIGS. 1, 3 and 4. The same will be readily understood looking at side views presented on other drawing figures herein.

As shown in FIG. 3, the actuation of the input actuators 124R and 124L is simultaneous with actuation of the tongue actuator 130 which causes the angle between the bridge 160 and the coupler links 122R and 122L to increase and simultaneous with unfolding of the bridge sections 160A and 160B and 160C from each other, even as the footing portion 122F is moving towards the ground line GL.

After the footing portion 122F of the bridge launching mechanism 120 has reached the position shown in FIG. 3, the input actuators 124R and 124L stop operation and the mechanism 120 is stationary except for tongue actuator 130 which continues to move the tongue 110 and the bridge sections 160A, 160B and 160C which continue unfolding until the tongue 110 has moved from its FIG. 3 to its FIG. 4 position, with the bridge 160 in the desired position by driving the vehicle 100 away from the bridge 160 causing tongue 110 to be withdrawn from the bridge 160 to which the tongue was interfaced by the pins 116R and 116L and two pins 118P.

The bridge 160 may be configured in numerous ways known in the art. Accordingly, it is shown only schematically. The actuators used with the present invention, as well as their pivotable attachment, are well known in the art and may use any of the numerous well known power sources and control circuits. Accordingly, the details of these well known in the art systems need not be discussed in detail.

Figure 5:
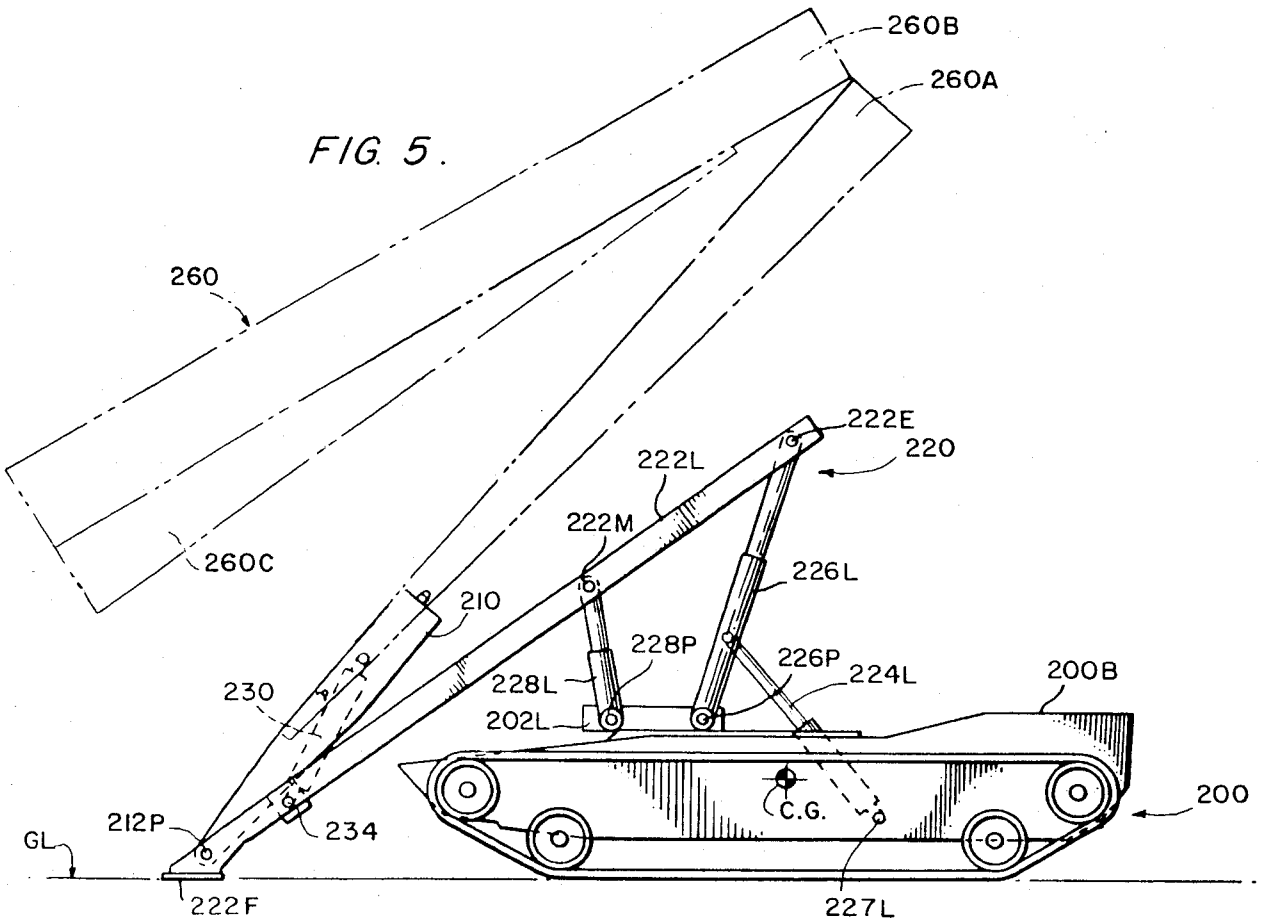
FIG. 5 shows a side view of a second embodiment of the present invention in the process of launching a bridge.

Referring to FIG. 5, it shows a side view of the second embodiment of the present invention. Only the left side members are shown in FIG. 5, but it will be readily understood that corresponding right side members are disclosed behind the left side members in the same fashion as the first embodiment.

The second embodiment of the present invention as shown in FIG. 5 includes an input link 226L which is adjustable in length. Likewise, the follower link 228L and corresponding right side links (not shown) are adjustable in length.

The second embodiment of the present invention also includes actuators 225F, 225M, 225E and 202A which are inside the left coupler link 122L and inside the support means 202L. It will be readily understood that the exact same members are located in the right hand side of the mechanism (not shown).

In addition, the pivot points 222M, 222E, 228P and 226P are slideably mounted in their respective supports 222L, 202L, 202R and 222R (not shown).

The operation of the second embodiment is essentially the same as that of the first embodiment except that the coupler link 222L and the right side coupler link (not shown) can be moved changing the length of the links 226L and 228L and their right side counterparts (not shown) and changing the positions of the pivots 222M, 222E, 228P, 226P and their right side counterparts (not shown). The right side members and corresponding left side members would, of course, move at the same time.

A distinct advantage of the embodiment shown in FIG. 5 is that the footing position 222F may be placed a variable distance from the vehicle 200. Specifically, by increasing the ratio between the lengths of input link 226L and follower link 228L, the footing portion 222F may be placed closer to the vehicle 200. Also, by slideably moving pivots 228P toward 226P, the footing 222F may be placed closer to the vehicle 200. Likewise, the footing portion 222F could be placed in any practical useful distance from the vehicle 200 and the coupler link 222L may be inclined at many different angles. The ability to change the dimensional relations between members of the bridge launching vehicle and mechanism is used to allow operation with different size and shape bridges under different conditions.

FIGS. 1,2 show left,right,upper and bottom visibility lines 136L,136R,136U, 136B respectively. The visibility lines indicate the visibility field of a driver/operator who could be disposed in a hole (not shown) in front of the turret hole or opening 106H. Such position of the driver/operator is well known in the art as commonly used with tanks. Also, the turret hole 106H is well known in the art as commonly used with tanks. Alternately, the driver/operator could be disposed at the front of the turret hole 106H. In either case, the driver-/operator would leave good visibility in either direction.

Figure 7:
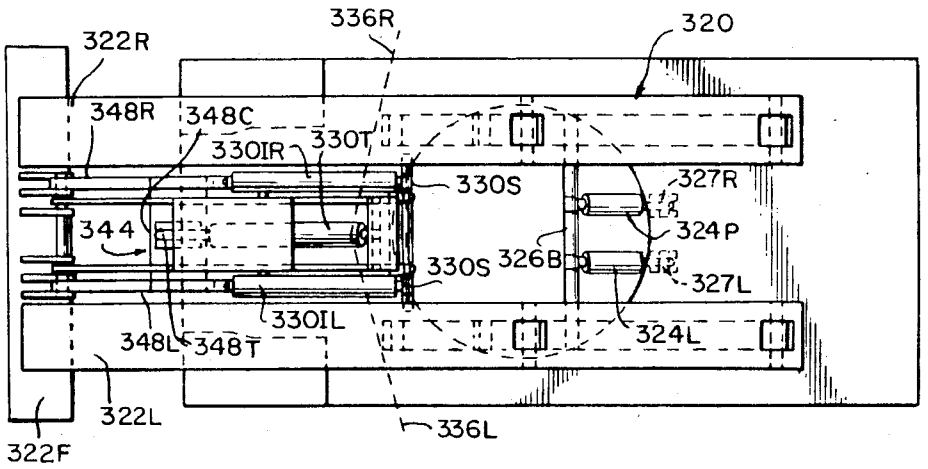
FIG. 7 shows a side view of a third embodiment of the present invention.
Figure 6:
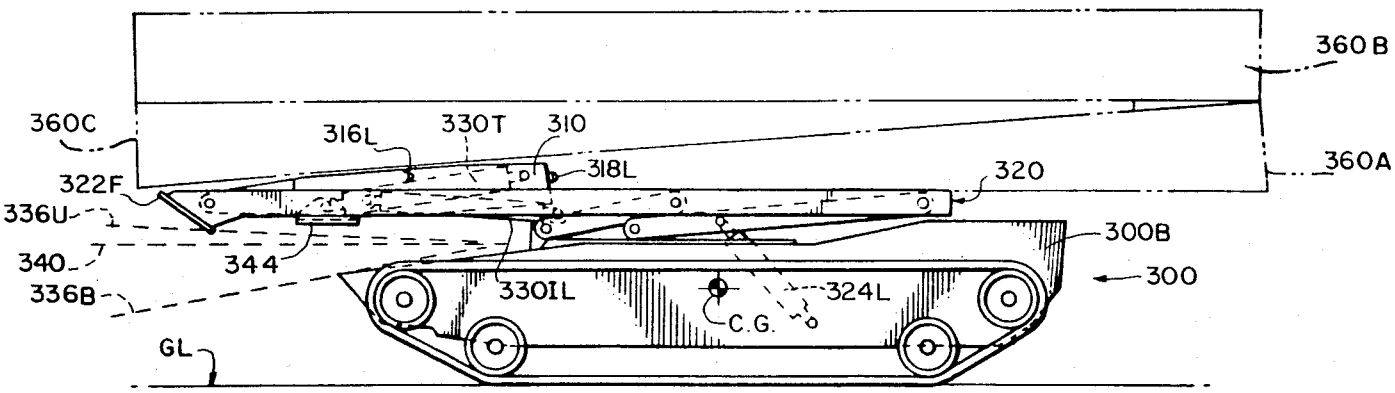
FIG. 6 shows a side view of a third embodiment of the present invention.
Figure 8:
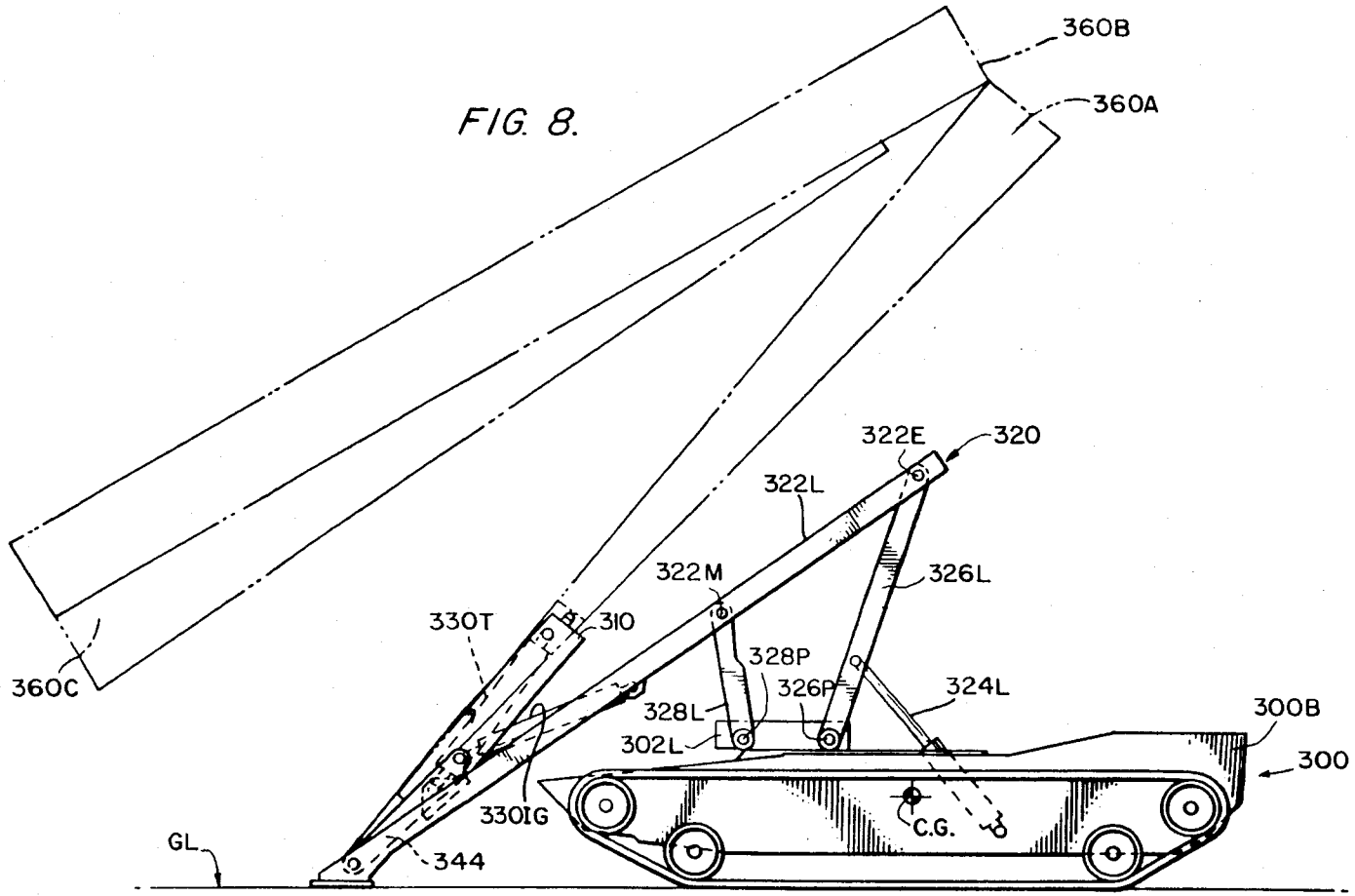
FIG. 8 shows a side view of the third embodiment of the present invention with the bridge partially unfolded.
Figure 9:
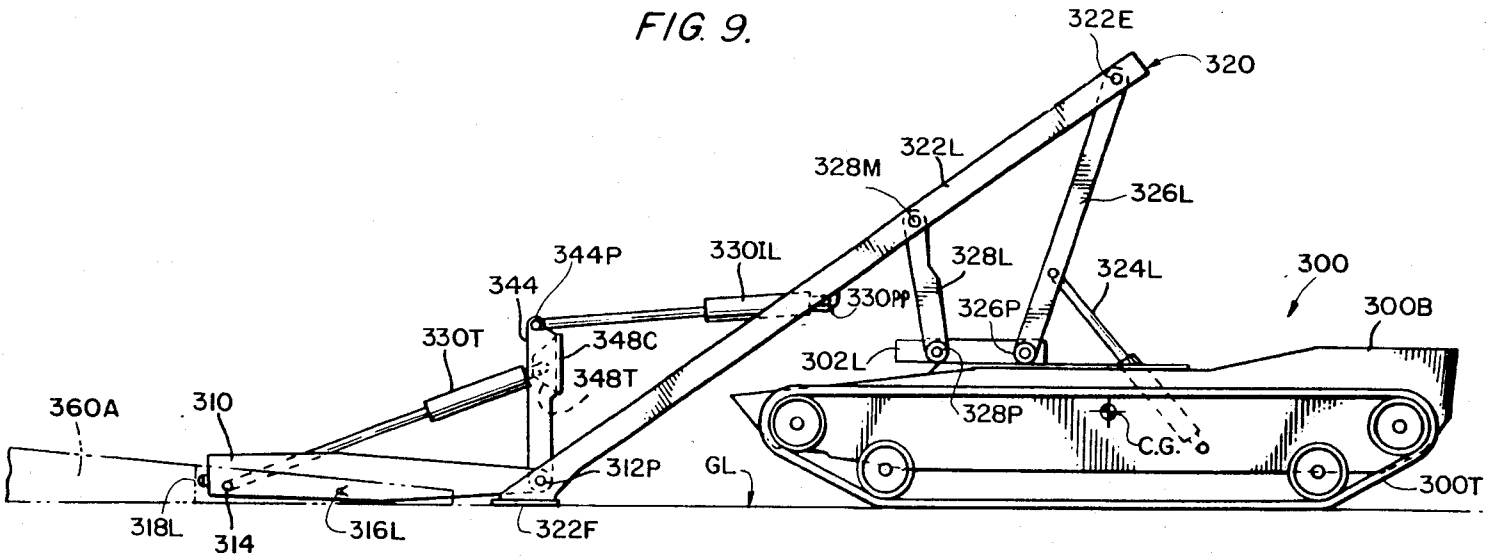
FIG. 9 shows a side view of the third embodiment with the bridge completely unfolded.

Referring to FIGS. 6 through 9, the third embodiment of the present invention will be described. FIG. 6 shows a side view; FIG. 7 shows a top view of the fourth embodiment. FIGS. 8 and 9 show side views with a bridge partially unfolded and completely unfolded respectively.

As with the previous embodiments, the parts are numbered with the same last two digits as the corresponding parts of the first embodiment shown in FIGS. 1 through 4.

Since the third embodiment of the present invention shown in FIGS. 6 through 9 include parts identical to the corresponding parts of the first embodiment, only the differences between the third and the first embodiments will be emphasized. Also, as with all preferred embodiments of the present invention, the bridge launching mechanism includes two parallel linkage arrangements, each including left and right input links, left and right follower links and left and right coupler links. The left side views are shown, and it will be readily understood that the right side parts (not shown) are disposed behind the corresponding left side parts.

The third embodiment shown in FIGS. 6 through 9 is different from the first embodiment in that an intermediate member 344, best shown in FIG. 9, is used to move the tongue 310 relative to the coupler links 322L and 322R. The intermediate member 344 is pivotably attached to the coupler links 322L and 322R at the footing portion 322F. For ease of illustration, the intermediate member 344 is shown pivoting on the same pivot 312P as the tongue 310. The tongue actuator 330T moves the tongue 310 relative to the intermediate member 344. Intermediate actuators 330IL and 330IR move the intermediate member relative to the coupler links 322L and 322R.

The intermediate actuators 330IL and 330IR are pivotably connected by sleeves 330S to the coupler links at a pivot pin 330PP extending between coupler links 322L and 322R. The other ends of intermediate actuators 330IL and 330IR are pivotably attached to the intermediate member 344 at pivots 344P. The tongue actuator 330T is pivotably attached to the intermediate member trunion 348T mounted on the connecting plate 348C extending between left and right parts 348R and 348L of the intermediate member 344. The other end of the tongue actuator 330T is pivotably attached to the tongue 310 at the pivot 314.

The operation of the third embodiment is essentially the same as that of the first embodiment except that the tongue 310 is moved by actuation of the intermediate actuators 330IL and 330IR and the tongue actuator 330T.

A distinct advantage of the third embodiment shown in FIGS. 6 through 9, and best seen in FIG. 9, is that the actuators 330T, 330IL and 330IR need not be as powerful as the actuator 130 of the first embodiment (FIG. 1), and need not operate over as wide an angle as the first embodiment actuator 130.

Figure 11:
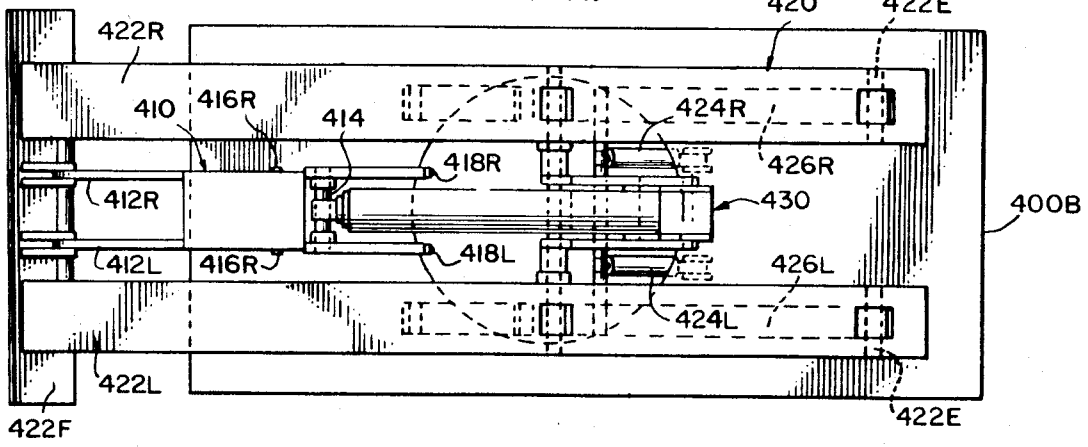
FIG. 11 shows a top view of the fourth embodiment of the present invention.
Figure 10:
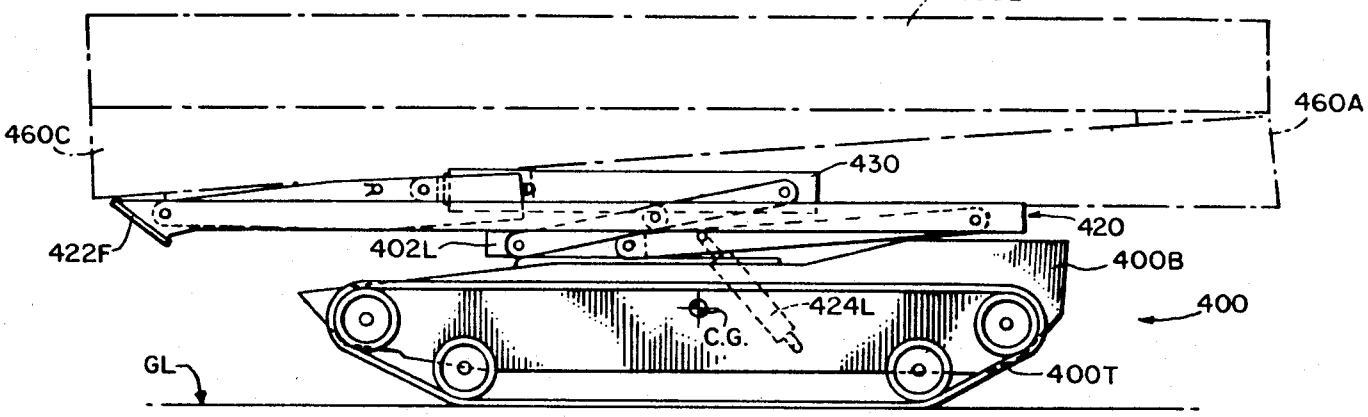
FIG. 10 shows a side view of a fourth embodiment of the present invention.
Figure 12:
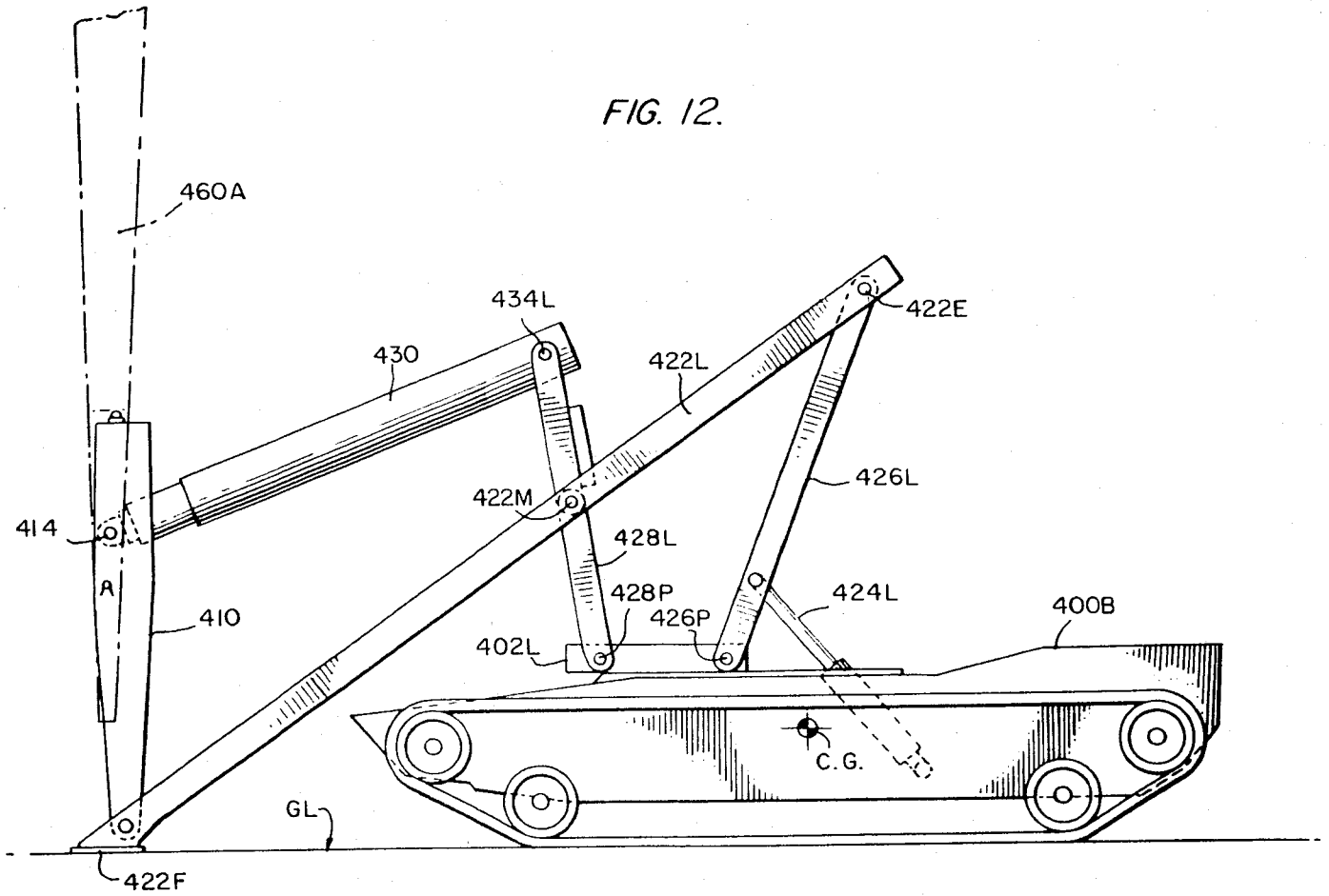
FIG. 12 shows a side view of the fourth embodiment of the present invention with the bridge partially unfolded.
Figure 13:
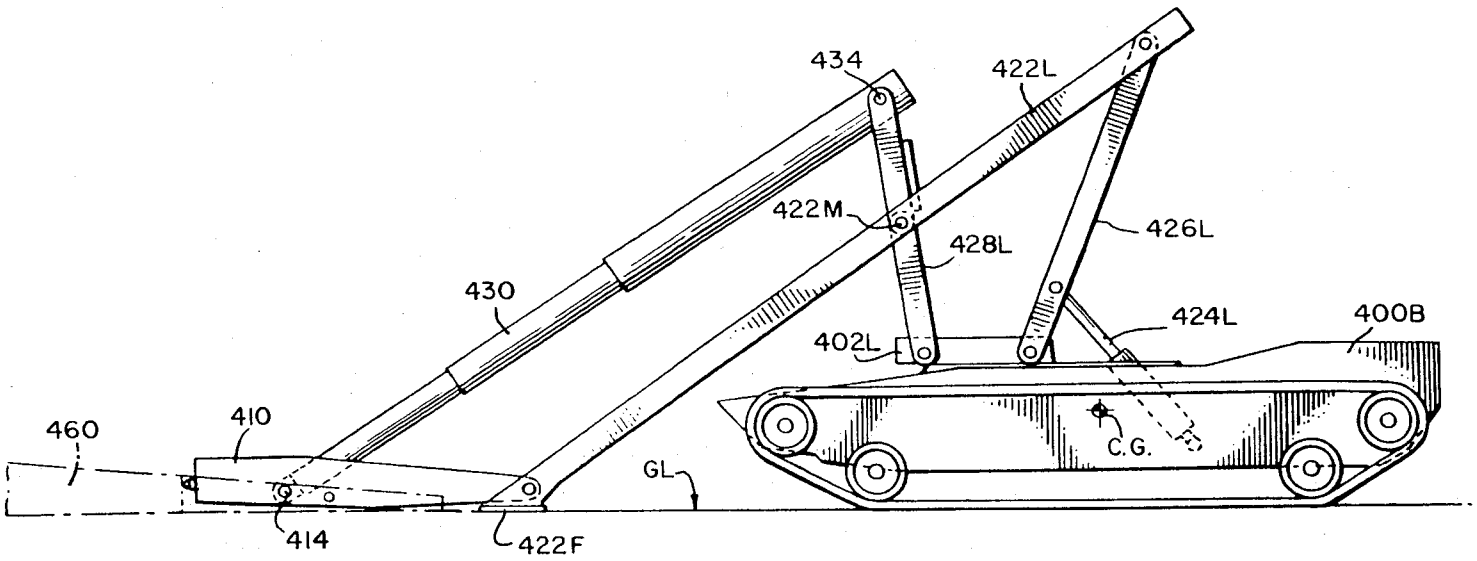
FIG. 13 shows a side view of the fourth embodiment of the present invention with the bridge completely unfolded.

A fourth embodiment of the present invention will be described. FIGS. 10, 12 and 13 show a side view of the fourth embodiment with launcher mechanism fully retracted, partially open and fully open respectively. FIG. 11 shows a top view of the fourth embodiment. Since the fourth embodiment of the present invention, shown in FIGS. 10 through 13, includes parts identical to the corresponding parts of the first embodiment (FIGS. 1 through 4), only the differnces between the fourth and the first embodiments will be emphasized. Also, as with all preferred embodiments of the present invention, the bridge launching mechanism includes two parallel linkage arrangements, each including left and right members. The left side views are shown, and it will be readily understood that the right side parts (not shown) are disposed behind the corresponding left side parts.

The fourth embodiment shown in FIGS. 10 through 13 is different from the first embodiment in that the follower links 428L and 428R (not shown) are extended beyond the pivot pins 422M as best seen in FIG. 12. Thus, the follower link 428L is pivotably attached to the support means 402L, and pivotably attached to the coupler link 422L at the pivot 422M, and pivotably attached to one end of a top actuator 430 at the pivotable attachment 434L. The other end of the top actuator is pivotably attached to the tongue 410 at the pivot 414.

The operation of the fourth embodiment is essentially the same as that of the first embodiment, except that the tongue actuator 130 from the first embodiment is replaced by the top actuator 430 in the fourth embodiment of the present invention and thus, as the actuator 424L moves the input link 426L, which moves the coupler link 422L, which in turn moves the extended follower link 428L in counterclockwise direction, which in turn moves the top actuator 430, which causes the tongue 410 to upfold. Basically then, the activation of the input actuators 424L and 424R (not shown) causes the tongue 410 to move to the position shown in FIG. 12 by virtue of the kinematic linkage construction. After activation of the top actuator 430, the tongue 410 will move to the position shown in FIG. 13.

Figure 14:
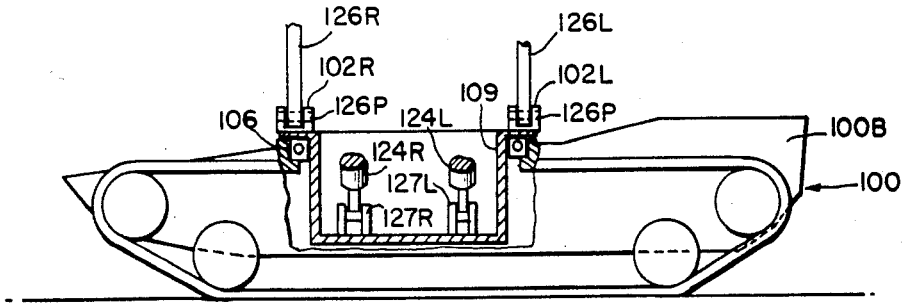
FIG. 14 shows a side view in partial cross section of the first embodiment of the present invention and illustrating a feature of the present invention which may be included in all of the other embodiments.

Refer to FIG. 14 where a specific arrangement for mounting the bridge launching mechanism 120 to the bridge launching and transporting vehicle 100 in accordance with the present invention is shown. The bridge launching mechanism 120 is shown only partially in FIG. 14. The numbers of the parts in FIG. 14 correspond to the numbers of the first embodiment of the present invention (FIGS. 1 through 4), but it will be readily understood that all of the embodiments may have this feature.

Specifically, an arrangement is shown whereby the support means 102L and 102R are mounted on the rotatable basket 109 which is mounted on the turret ring. Both the basket 109 and the turret ring 106 are well known in the art for use in tanks and will not be described in detail. The basket 109 has a floor to which the input actuators 124R and 124L (partially shown) are mounted. The input actuators could be mounted to the sides of the basket 109 as well.

As is well known in the art, the basket is rotatable with respect to the vehicle's body 100. Since the bridge launching mechanism 120 is mounted to the basket 109, the bridge could be launched in any direction with respect to the vehicle's body 100.

The basket 109 is shown open on the top with only the support means 102L and 102R extending across the basket 109. The basket 109 is rotatable by means of a drive mechanism (not shown) which could be of any type well known in the art for rotation of the tank turrets and baskets.

As shown on the FIG. 14, the launching mechanism is rotated 90 degrees to the left from the straightforward position. The bridge would be launched perpendicular to the plane of the FIG. 14 toward the observer or to the left of the vehicle. Although the basket 109 is shown as a cylinder, the only part which requires cylindrical shape is that interfacing with the turret ring 106; otherwise, the basket 109 may be of any practical shape.

An explanation of the underlying concepts for operating the various embodiments of the bridge launching mechanisms of the present invention will now be discussed with specific reference to FIG. 4, it being readily understood that the mechanics of operation is essentially the same for the other embodiments. As shown in FIG. 4, the bridge launching mechanism 120 of the present invention is seen as using a four bar mechanism which is the simplest closed kinematic chain of hinged links with a single degree of freedom (one link-chassis fixed). A four bar mechanism by itself is well understood in the art and has heretofore been used in machines such as punch presses and film transports among others.

Four bar mechanisms are often classified according to a relationship known as Grashof's criterion depending upon the relative lengths of the various parts. For example, considering the embodiment of FIGS. 1 through 4, the following variables may be used for Grashof's inequality:

| | | |
|---|---|---|
| S | rail support | length of 102L between 128P and 126P |
| l | input link | length of 126L between 126P and 122E |
| q | follower link | length of 128L between 128P and 122M |
| p | coupler | length of 122L between 122E and 122M |

A Grashoffian mechanism, as all of the present invention's linkage arrangements are, required that $s+1$ is less that $p+q$. The four bar mechanism realized by the embodiment of FIGS. 1 through 4 is commonly called a double-crank mechanism since the shortest bar is the rail or fixed bar 102L. However, various other relationships may be used for the relative lengths of the four bars making up the mechanism provided that Grashof's inequality is satisfied and provided that the input link 126L is longer than the follower link 128L. This same relationship should obviously be met for the right side linkage including coupler 122R and the associated parts. Likewise, this analysis would also apply to the bridge launching arrangements shown in the other embodiments of the present invention. Of course, the embodiment of FIG. 5 allows one to change the lengths and/or position of pivots of the links and, therefore, provides great flexibility in placing the foot of the couplers.

Figure 16:
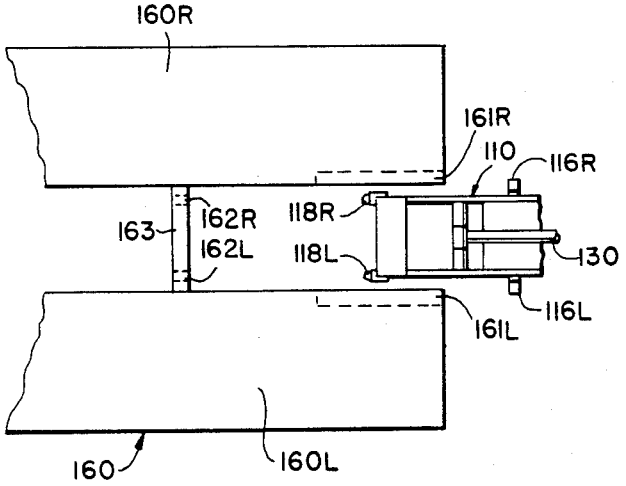
FIG. 16 shows a top view of the interface of FIG. 15.
Figure 15:
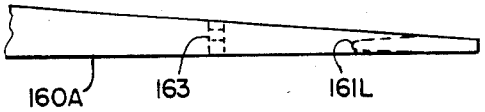
FIG. 15 shows a side schematic view of a tongue and bridge interface.

Referring to FIGS. 4, 15 and 16, the relationship between the bridge 160 and the tongue 110 will be described. Since the tongue to the bridge interface is well known in the art, the most important features will be emphasized. These features will be described as the connection between the tongue and the unfolded bridge is made.

The tongue 110 is moving toward the bridge 160. As the distance between them closes, the tongue 110 enters the space between the left and right part of the bridge (160L and 160R). The guide pins 116L and 116R start sliding over the guides 161R and 161L, thus lifting the tongue 110. As the pins 116R and 116L are engaged in guides 161R and 161L, the cone section of the pins 118R and 118L enters the holes 162R and 162L in the bridge crossbrace 163. As the guide pins 116L and 116R approach the end of the guides 161L and 161R, the cylindrical section of the pins 118L and 118R engage the holes 162L and 162R. When this is completed, the connection between the bridge 160 and the tongue 110 is rigid and pins 116 and 118 are capable of transferring any forces and moments occurring during launching or retrieving.

It will be readily appreciated that the variable length and position of input and follower links of the FIG. 5 embodiment and the rotatable bridge launching mechanism of FIG. 14 could be combined with each other. Moreover, either or both of these features, in full or in part, could be used with any of the embodiments of the present invention.

As briefly referred to hereinabove, suitably locating the attachment points between the side links, support means and coupler link with respect to the vehicle's center of gravity makes the bridge launcher according to the invention self-correcting in the event it is lifted from the ground during launch or retrieval of a bridge. Specifically, referring to FIG. 3 for example, this is accomplished by so arranging the mechanism on the vehicle that when the footing portion 122F of the coupler link is on the ground, the horizontal distance from said footing portion to the vehicle's center of gravity C.G. is greater than the horizontal distance from said footing portion to the point of intersection of two straight lines, one drawn through the attachment points 122M and 128P for one side link and the other drawn through the attachment points 122E and 126P for the other side link.

While I have shown and described certain present preferred embodiments of the invention, it is to be distinctly understood that the invention is not limited thereto, but may be otherwise variously embodied within the scope of the following claims.

I claim:

1. A bridge transporting, launching and retrieving vehicle comprising:

(a) a vehicle body and chassis;

(b) at least one input link pivotably attached to the vehicle body;

(c) at least one follower link pivotably attached to the vehicle body;

(d) at least one input actuator operative for moving at least a part of the input link relative to the body;

(e) at least one coupler link having a first end, a middle portion and a second end opposite the first end with a footing portion disposed at the first end, and wherein the input link is pivotably attached to the coupler link at the second end, the follower link is pivotably attached to the coupler link at the middle portion, and the vehicle is operable to launch or retrieve a bridge by moving at least a part of the input link; and (f) at least one interfacing member attached to the coupler link at the first end for connecting a bridge to said vehicle.

2. The bridge transporting, launching and retrieving vehicle of claim 1 further comprising:

(a) an intermediate member pivotably attached to the first end of the coupler link; and (b) an intermediate actuator pivotably attached to the intermediate member to move the intermediate member relative to the coupler link, and an interface actuator attached to the interfacing member for moving the interfacing member relative to the intermediate member.

3. The bridge transporting, launching and retrieving vehicle of claim 1 in which the interfacing member is a tongue member pivotably attached at one end to the first end of the coupler link, and a tongue actuator is attached to the tongue member for moving the tongue member relative to the coupler link.

4. The bridge transporting, launching and retrieving vehicle of claim 3, wherein the interfacing tongue member is disposed at an acute angle relative to the coupler link when the vehicle is supporting an unlaunched bridge and moves to an obtuse angle relative to the coupler link when the vehicle launches or retrieves a bridge.

5. The bridge transporting, launching and retrieving vehicle of claim 3, wherein the tongue actuator is also attached to the coupler link.

6. The bridge transporting, launching and retrieving vehicle of claim 3, wherein the tongue actuator is also attached to the follower link.

7. The bridge transporting, launching and retrieving vehicle of claim 1, wherein at least one of the input and follower links is adjustable in length.

8. The bridge transporting, launching and retrieving vehicle of claim 1, wherein the position of at least one end of the pivotable attachment of at least one of the input and follower links is adjustable.

9. The bridge transporting, launching and retrieving vehicle of claim 1, wherein the input link, coupler link and follower link are movable as a unit with respect to the vehicle body about a vertical axis for launching bridges in different directions relative to said vehicle body.

10. The bridge transporting, launching and retrieving vehicle of claim 1, wherein at least one of a second input link, a second follower link, and a second coupler link is attached and operable in the same fashion as the input link, follower link and coupler link respectively.

11. The bridge transporting, launching and retrieving vehicle of claim 1 in which the attachment points of the input and follower links to the coupler link and to the vehicle body are so positioned that, when the footing portion is spaced from the vehicle and in contact with a surface on which the vehicle rests, the horizontal distance from the footing portion to the center of gravity of the vehicle is greater than the horizontal distance from the footing portion to the point of intersection of a first straight line drawn through the attachment points of the input link to the coupler link and to the vehicle body with a second straight line drawn through the attachment points of the follower link to the coupler link and to the vehicle body.

12. A bridge launching and retrieving mechanism comprising:

(a) support means;

(b) at least one follower link pivotably attached to said support means;

(c) at least one coupler link having a first end, a middle portion, and a second end, opposite the first end, with a footing portion disposed at the first end, and wherein the follower link is pivotably attached to the coupler link at the middle portion;

(d) first actuation means for moving the coupler link relative to the support means, the first actuation means operable to launch or retrieve a bridge by moving the follower link and coupler link relative to the support means;

(e) interfacing means attached at the first end of the coupler link; and (f) second actuation means for moving the interfacing means relative to the coupler link.

13. The bridge launching and retrieving mechanism of claim 12 wherein the second actuation means is pivotably attached to the coupler link.

14. The bridge launching and retrieving mechanism of claim 12 wherein at least one input link is pivotably attached to the coupler link at the second end.

15. The bridge launching and retrieving mechanism of claim 14 including at least one intermediate member attached pivotably to the first end of the coupler link and to the second actuation means, and third actuation means attached to the intermediate member to move the intermediate member relative to the coupler link.

16. The bridge launching and retrieving mechanism of claim 14 wherein the second actuation means is attached to the follower link for moving a bridge relative to the coupler link.

17. The bridge launching and retrieving mechanism of claim 14 wherein at least one of the follower, coupler and input links is adjustable in length.

18. The bridge launching and retrieving mechanism of claim 17 wherein at least one of the claimed links is adjustable in respect of the position of at least one of its pivotable attachment points.

19. The bridge launching and retrieving mechanism of claim 18 including at least one of a second input link, a second follower link, and a second coupler link attached and operable in the same fashion as the input link, the follower link, and the coupler link respectively.

20. The bridge launching and retrieving mechanism of claim 14 wherein the first actuation means includes an input actuator pivotably attached both to the support means and to the input link.

21. The bridge launching and retrieving mechanism of claim 14 wherein said input link, coupler link, follower link are movable as a unit with respect to said support means about a vertical axis for launching bridges in different directions relative to said support means.

22. A bridge transporting, launching and retrieving vehicle comprising:

(a) a vehicle body;

(b) support means rotatable about a vertical axis mounted to said vehicle; and (c) a bridge launching and retrieving mechanism attached to the support means, whereby the bridge launching mechanism is operative to launch bridges in different directions relative to the vehicle body, wherein the bridge launching and retrieving mechanism comprises:

(d) at least one follower link pivotably attached to the rotatable support means;

(f) at least one coupler link having a first end, middle portion and second end opposite the first end, with a footing portion disposed at the first end and wherein the follower link is pivotably attached to the coupler link at the middle portion;

(g) first actuation means for moving the coupler link relative to the rotatable support means and operable to launch or retrieve a bridge by moving the follower link and coupler link relative to the vehicle body and rotatable support means;

(h) interfacing means attached at the first end of the coupler link; and (i) second actuation means for moving the interfacing means relative to the coupler link.

23. The bridge transporting, launching and retrieving vehicle of claim 22 wherein at least one input link is pivotably attached to the second end of the coupler link and pivotably attached to the rotatable support means.

24. The bridge transporting, launching and retrieving vehicle of claim 23 including at least one intermediate member attached pivotably to the first end of the coupler link and to the second actuation means and third actuation means attached to the intermediate member to move the intermediate member relative to the coupler link.

25. The bridge transporting, launching and retrieving vehicle of claim 23 wherein the second actuation means is attached to the follower link for moving a bridge relative to the coupler link.

26. The bridge transporting, launching and retrieving vehicle of claim 23 including at least one of a second input link, a second follower link, and a second coupler link attached and operable in the same fashion as the input link, the follower link and the coupler link respectively.

27. The bridge transporting, launching and retrieving vehicle of claim 26 wherein at least one of the follower, coupler and input links is adjustable in length.

28. The bridge transporting, launching and retrieving vehicle of claim 27 wherein at least one of the claimed links is adjustable in respect of the position of at least one of its pivotable attachment points.

29. The bridge transporting, launching and retrieving vehicle of claim 23 in which the attachment points of the input and follower links to the coupler link and to the rotatable support means are so positioned that, when the footing portion is spaced from the vehicle and in contact with a surface on which the vehicle rests, the horizontal distance from the footing portion to the center of gravity of the vehicle is greater than the horizontal distance from the footing portion to the point of intersection of a first straight line drawn through the attachment points of the input link to the coupler link and to the rotatable support means with a second straight line drawn through the attachment points of the follower link to the coupler link and to the rotatable support means.

30. A bridge transporting, launching and retrieving vehicle as claimed in any of claims 24 through 29 wherein said vehicle body has an opening and said rotatable support means comprises a basket mounted and rotatable in said opening.

31. A bridge transporting, launching and retrieving vehicle comprising:

(a) a vehicle body and chassis;

(b) support means rotatable about a vertical axis mounted to said vehicle; and (c) a bridge launching and retrieving mechanism attached to the support means and operative to launch bridges in different directions relative to the vehicle body; and wherein said vehicle body has an opening and said rotatable support means comprises a basket mounted and rotatable in said opening.

* * * * *